US007800497B2

(12) United States Patent
Marusak et al.

(10) Patent No.: US 7,800,497 B2
(45) Date of Patent: Sep. 21, 2010

(54) WIRELESS DETECTION SYSTEM

(75) Inventors: Thomas J. Marusak, Loudonville, NY (US); John A. Corey, Melrose, NY (US)

(73) Assignee: Comfortex Corporation, Watervliet, NY (US)

( * ) Notice: Subject to any disclaimer, the term of this patent is extended or adjusted under 35 U.S.C. 154(b) by 275 days.

(21) Appl. No.: 11/952,584

(22) Filed: Dec. 7, 2007

(65) Prior Publication Data

US 2008/0143524 A1 Jun. 19, 2008

Related U.S. Application Data

(60) Provisional application No. 60/873,391, filed on Dec. 7, 2006.

(51) Int. Cl.
*G08B 13/08* (2006.01)

(52) U.S. Cl. ..... 340/545.1; 340/545.7; 340/545.8; 340/541

(58) Field of Classification Search ..... 340/545.1, 340/540, 541, 546, 545.2, 547, 545.3, 545.7, 340/545.8, 551, 552, 561, 572.3, 572.8; 250/505.1, 250/506.1, 515.1, 496.1, 497.1

See application file for complete search history.

(56) References Cited

U.S. PATENT DOCUMENTS

| | | | | |
|---|---|---|---|---|
| 6,353,220 | B1 * | 3/2002 | Sar | 250/239 |
| 7,019,639 | B2 | 3/2006 | Stilp | |
| 2006/0187061 | A1 * | 8/2006 | Colby | 340/572.8 |
| 2007/0080806 | A1 * | 4/2007 | Lax et al. | 340/572.1 |

* cited by examiner

*Primary Examiner*—Toan N Pham
(74) *Attorney, Agent, or Firm*—Rader, Fishman & Grauer PLLC

(57) ABSTRACT

A system is disclosed including a transponder and a shield. The transponder may be a radio frequency identification (RFID) transponder and sends a signal to a reader. The shield selectively prevents the transponder from sending the signal. The transponder and the shield are selectively movable relative to each other to permit transmission of the signal from the transponder. A movement of the transponder and the shield relative to each other is indicated by the presence of the signal. Thus, when a signal is present, due to a change or increase of the movement of the shield relative to the transponder, the reader receives an indication of a disturbance or an intrusion.

17 Claims, 10 Drawing Sheets

WIRELESS DETECTION SYSTEM

CROSS-REFERENCE TO RELATED APPLICATIONS

This application claims priority to U.S. Provisional Patent Application 60/873,391, filed Dec. 7, 2006, the disclosure of which is hereby incorporated by reference in its entirety.

BACKGROUND

Security systems are typically installed in new structures using wired communication from door and window switches to a central control unit. A common sensor for detecting an open door or window is a reed switch having a magnet on a movable member (e.g., the window frame or door frame). However, such installations are costly. When retrofitting a security system in a house or structure, wired methods are even more expensive to install because there is no easy access to the underlying wall structure.

Wireless security systems are available and also include a sensor (e.g. a reed switch and magnet) and a wireless transmitter. However, such wireless security systems require that the sensor be placed on a door or window to detect an open condition. Such sensors may be unreliable due to the wired connection to the transmitter. Additionally, the wireless transmitter requires mounting, which may be conspicuous. These systems include a transmitter that detects an open window or door via the sensor and transmits the status. Indeed, the status is transmitted for both an open and closed condition of the door or window. Moreover, the absence of the wireless signal indicates that the sensor or transmitter has been tampered with.

Detecting whether or not there is a disturbance of a portal feature, such as a window treatment or blind, is useful for safety purposes. For example, in a child safety application, a homeowner may desire a system that detects whether or not a portal feature (e.g., a window or a blind) has been disturbed, rather than one that only detects whether an intrusion has taken place. In such safety applications, a child or pet may play with or otherwise disturb a portal feature. A user (e.g., a parent or caretaker) desires to be alerted to such an event (e.g., a disturbance) so that appropriate action can be taken.

BRIEF DESCRIPTION OF THE DRAWINGS

The features and inventive aspects of the present invention will become more apparent upon reading the following detailed description, claims, and drawings, of which the following is a brief description:

DETAILED DESCRIPTION

Figure 1:
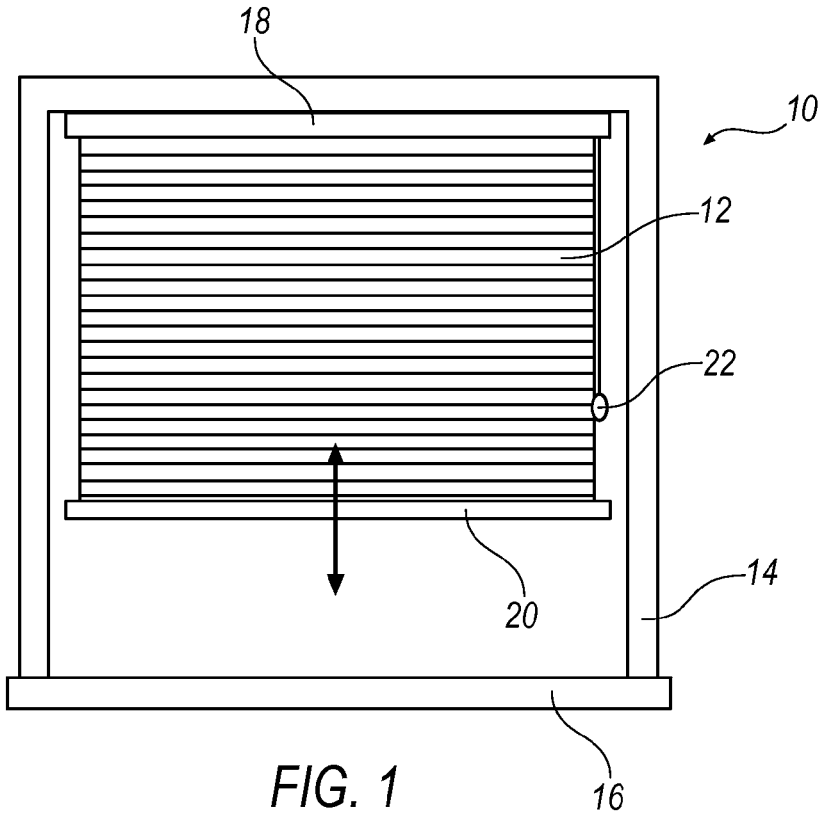
FIG. 1 is an interior view of a window and window treatment for use with an embodiment.

The embodiments disclosed herein generally concern using wireless transponders to monitor one or more openings or portals of an enclosure, such as a house, a room, a vehicle, or the like. A wireless transponder is attached to a window covering, a window sash, a door, or other movable portal feature, along with a shield on an adjacent stationary feature, such as a window sill or frame. A reader is provided to communicate with the transponder to detect an intrusion or a disturbance. As discussed herein, a portal is a general opening, such as a door, a window, and a portal may include a portal feature, such as an accessory for the portal. For example, a portal feature may include a window, a door, a window treatment, a covering, a blind, a shade, a screen, a storm door, or the like. A portal feature may include structure(s) near to, within, adjacent to, or at least partially covering a portion of, a portal. The portal feature may also include any feature within or covering a portal that is intended to be selectively movable, open, or closed.

The transponder may be on the stationary feature and the shield on a movable portal feature. A typical installation includes a radio frequency identification (RFID) transponder connected to a window treatment and in proximity to a shield that blocks radio frequency (RF) transmissions. Wien the movable portal feature is moved, such as when an intruder may open a window or a child may explore the area, the transponder is moved away or separated from the shield, or the shield is moved away from the transponder, and the transponder then indicates the disturbed nature of the portal by an RF transmission to the reader.

A disturbance as discussed herein generally describes a movement or upsetting of a steady state condition of a portal, a portal feature, and/or a window treatment, etc. For example, a disturbance may be caused by wind or physical interaction that may cause movement of the transponder, shield, antenna, portal, portal feature, window treatment, and/or other related elements that may inhibit or provide for the transmission of a signal from the transponder. Thus, the disturbance is generally defined as generic language that indicates a movement of an element of the systems described herein. Moreover, as discussed in detail herein, a transponder may be mounted to a bottom rail of a window treatment and a shield may be mounted to a window sill. A disturbance of the window treatment will also disturb the transponder (attached to the bottom rail) where the disturbance is great enough to move the bottom rail.

The disclosed embodiments are capable of detecting a disturbance to a portal, which includes the portal opening, closing, or simply an amount of movement of a portal treatment, such as the blinds moving on a window. As such, the disclosed embodiments are useful for a wide variety of applications, including child safety. For example, a child or pet may play with or otherwise disturb a portal feature and a user, such as a parent or caretaker, may desire to be alerted to such an event so that appropriate action can be taken.

In an embodiment, in an undisturbed state the transponder does not transmit an RF signal to the reader because the shield prevents RF transmissions. In alternative embodiments, an RF signal is present indicating an undisturbed state. Where a passive RFID transponder is used, the shield further prevents the transponder from receiving an RF transmission from the reader, and as such, prevents the passive transponder from receiving and responding to the reader's RF transmission. In an undisturbed state (i.e., a secure state) the reader does not sense the presence of the transponder. The movement of the window, window treatment, or door, exposes the transponder and the presence of a signal from the transponder triggers the detection of an unauthorized access.

In an alternative embodiment, the transponder transmits an RF signal to the reader in an undisturbed state. Thus, in an undisturbed state (i.e., a secure state) the reader senses the presence of the transponder. The movement of the window, window treatment, or door, prevents the transponder from transmitting a signal (or at least an RF signal strong enough to reach the reader) and the absence of a signal from the transponder triggers the detection of an unauthorized access.

As discussed herein, radio frequency identification (RFID) refers generally to an identification technology developed for identifying objects. However, it is understood that the discussion of the embodiments, including RFID components, may also use other suitable wireless technologies including, for example, radio frequency and infrared communications. RFID communications are performed between a reader (e.g., an RFID interrogator or reader) and a transponder (e.g., an RFID tag or RFID transponder). The reader is a fixed or mobile unit that is capable of receiving signals from the transponder. The transponder is typically an inexpensive fixed-purpose device that may include digitally encoded information for identification purposes.

The receiver is typically embodied as a transceiver that both transmits and receives radio frequency signals. The reader includes an antenna and queries and receives information from the transponder. The reader may also power the transponder where passive transponders are used (explained below in detail) and may include a processor for performing operations, e.g. sending information to another station indicating the presence of a transponder signal.

Transponder types may include passive or semi-passive types. A passive transponder does not include an on-board power supply (e.g. a battery) and is powered by RF transmissions from the reader. Moreover, passive transponders are typically very small and thin (e.g., approximately the size of a postage stamp). Because passive transponders do not include a power supply which degrades over time, the passive transponders typically have an unlimited useful life. A semi-passive (or active) transponder includes an on-board power supply (e.g., a battery) that self powers the transponder circuitry and allows for more sophisticated communication sessions with the reader. Semi-passive transponders typically only use the on-board power for an outgoing transmission. Additionally, each transponder may be programmed with a code for identification purposes. The code may be the same, which is used to identify a group of transponders, or the code may be unique in which case each particular transponder is identified (explained ill detail below with respect to FIG. 7).

FIG. 1 is an interior view of a window 10 and window treatment 12 for use with an embodiment. Window 10 is considered a portal and generally embodies any location or aperture that would allow unauthorized access or egress. Window 10 includes a window frame 14 and a window sill 16. Window treatment 12 includes a head rail 18, a bottom rail 20, and an actuator 22. Head rail 18 is connected to window frame 14 at the top portion. Actuator 22 is typically a pull cord having a tassel and allows for movement of bottom rail 20 to extend or retract window treatment 12. The movement of window treatment 12 in response to the actuator is shown with the double arrow (i.e., the movement is up and down).

Figure 2:
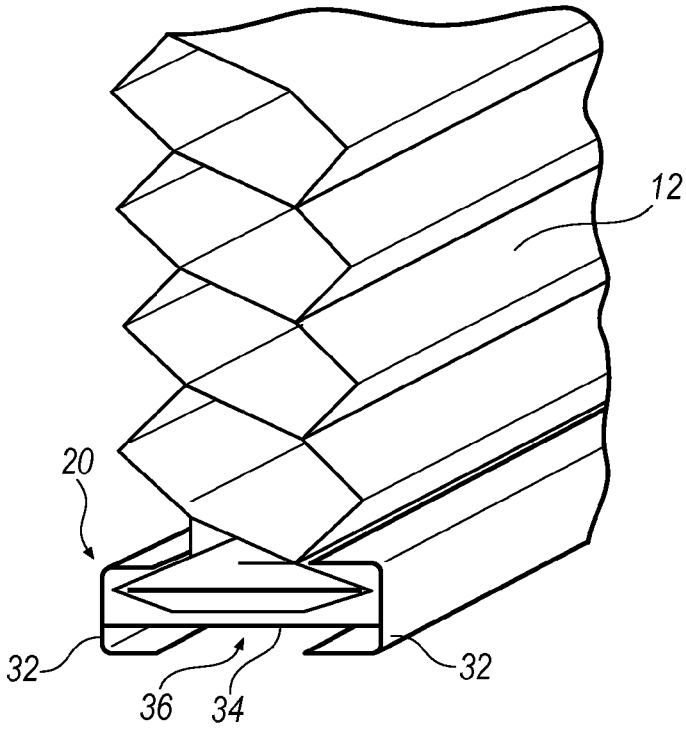
FIG. 2 is a perspective view of window treatment and bottom rail according to an embodiment.

FIG. 2 is a perspective view of window treatment 12 and bottom rail 20 according to an embodiment. Window treatment 12 is shown, for example, as a double cellular fabric. Bottom rail 20 is metallic and includes a face extension 32, a base plate 34, and a cavity 36. Although described here as metallic, bottom rail 20 may be constructed in any manner cooperating to prevent low-power RF transmissions (described below in detail with respect to FIG. 3). Face extension 32 extends below base plate 34 such that cavity 36 is formed below base plate 34. Cavity 36 is surrounded on three (3) sides by face extensions 32 and base plate 34.

Figure 3:
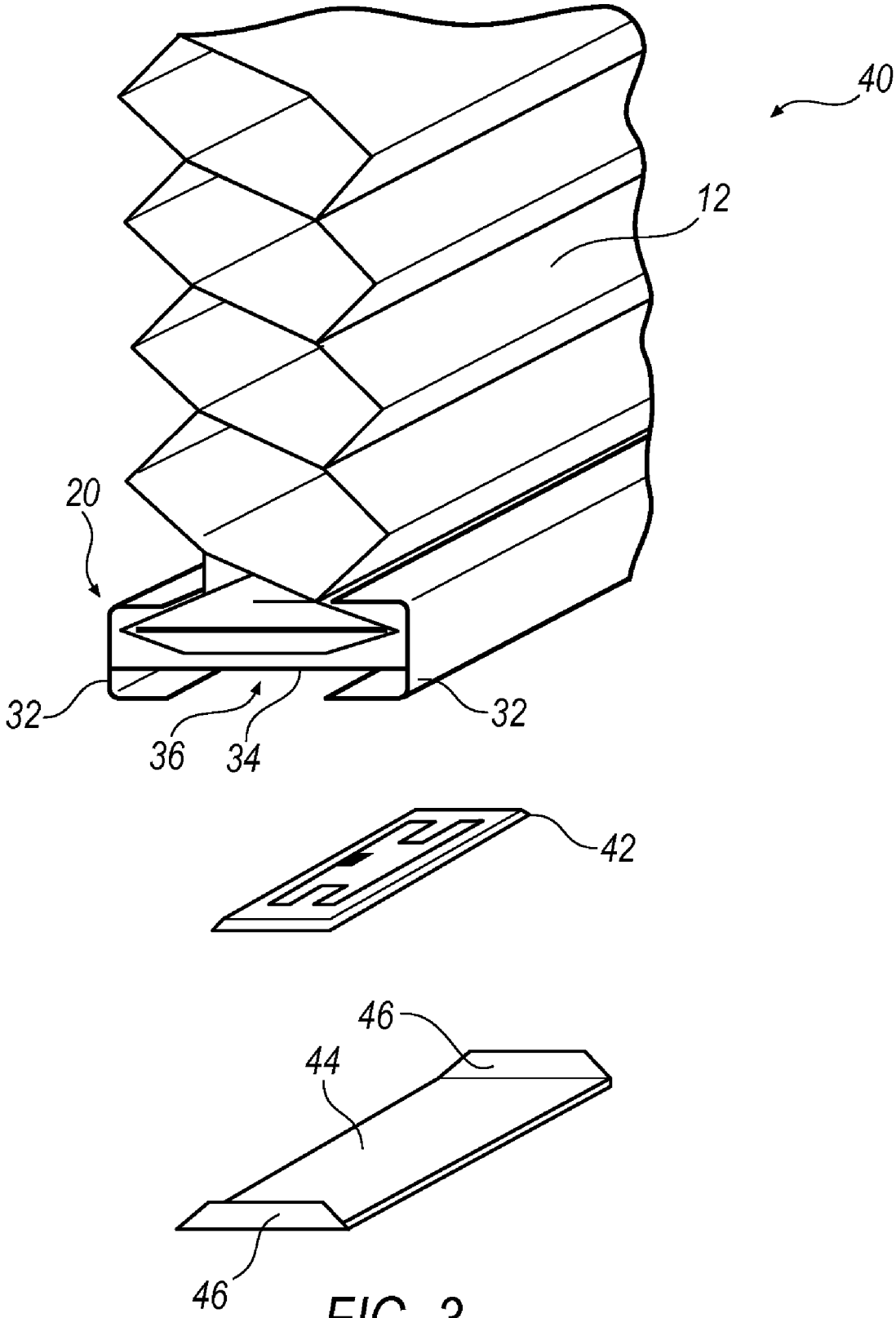
FIG. 3 is a perspective view of a transponder arrangement including window treatment, bottom rail, transponder, and shield for use with the embodiment of FIG. 2.

FIG. 3 is a perspective view of a detection transponder arrangement 40 including window treatment 12, bottom rail 20, a transponder 42, and shield 44 for use with the embodiment of FIG. 2. In one embodiment, transponder 42 may be affixed to base plate 34 in cavity 36. Alternatively, transponder 42 may be affixed to shield 44. It is also contemplated that other embodiments may include, for example, affixing transponder 42 to elements of doors. In one embodiment, transponder 42 is provided in a peelable label on window treatment 12 (where it provides tracking of product during manufacture and shipment), and is removable for repositioning in a more advantageous location with shield 44, as determined at installation for best communication with a reader 52 or for other local benefits including aesthetics or functionality.

Shield 44 is typically made of metal and includes raised ears 46 that cooperate with cavity 36 to enclose transponder 42. Cavity 36 is closed on three (3) sides by face extensions 32 and base plate 34. When bottom rail 20 is lowered proximal to shield 44, raised ears 46 and shield 44 cooperate with bottom rail 20 to fully enclose transponder 42. Thus, transponder 42 is fully enclosed and cannot transmit RF signals from cavity 36 to the surrounding environment. In effect, transponder 42 is enclosed in a Faraday cage. When discussed herein, the terms shielded, enclosed, and surrounded, as relating to transponder 42, mean that transponder 42 is substantially prevented from receiving or transmitting an RF signal beyond the confines of such shield or cage. In one embodiment, the shielding may result from use of a material (e.g., a metal or a conductive plastic) that substantially prevents transponder 42 from sending an RF signal (i.e., a transmission). Moreover, shielding may be accomplished using a combination of material type and/or configuration (e.g. foil, sheet) that substantially prevents an RF transmission from transponder 42. In some instances, such as when using semi-passive transponder 42, the shielding may also prevent transponder 42 from receiving a transmission from reader 52.

In an embodiment, bottom rail 20 and shield 44 are made of metal, or if bottom rail 20 is made of wood or other RF-transmissive material, a metal plate, for example, is affixed thereto in the location corresponding to the shield 44. It is also contemplated that other materials may be used to entirely shield transponder 42 or dampen RF transmissions such that a reader will not properly receive a signal from transponder 42. For example, bottom rail 20 and shield 44 may be made of metal, conductive plastic, conductive mesh, or other RF blocking material. In other embodiments, they may be plastic or wood including a foil to substantially prevent RF communications; for example, a wooden door that is thick enough to block RF transmissions of a predetermined amplitude or frequency range from an RFID transponder.

As shown, when bottom rail 20 is not proximal to shield 44, transponder 42 is not fully enclosed and may transmit a signal capable of reception by a reader. In another embodiment, transponder 42 is positioned on bottom rail 20 (which is movable). When window treatment 12 is fully deployed in a downward position, an intrusion through window 10 or other dislocation of window treatment 12 will result in movement of bottom rail 20 and rail-mounted transponder 42 away from shield 44. In this embodiment, transponder 42 (attached to bottom rail 20) becomes unshielded as bottom rail 20 is separated from shield 44. In an alternative embodiment, if transponder 42 is mounted on shield 44, an intrusion through window 10 or other dislocation of window treatment 12 will result in movement of extensions 32 and base plate 34 away from transponder 42. In this embodiment, transponder 42 (attached to shield 44) becomes unshielded as bottom rail 20 is separated from shield 44. Either embodiment results in exposure of transponder 42 and the emission of a signal that can be received by reader 52 when bottom rail 20 is separated from shield 44. As described herein, the embodiments do not require a sensor, such as a reed switch and magnet. Moreover, the portal (e.g., window or door) is not monitored for its position by a sensor. The embodiments do not require transponder 42 (e.g., an RFID transponder or tag) to be attached to any sensor. By using a system where the presence or absence of a signal is determined by the position of the transponder relative to a shield, no sensors are required. Rather, the absence of a signal or the presence of a signal from transponder 42 is monitored.

Generally, in defining an appropriate distance that shield 44 is spaced apart from transponder 42 (attached to bottom rail 20), the distance to prevent a signal from being transmitted is a function of the operating frequency of transponder 42. The maximum distance to prevent a signal from being transmitted from transponder 42 is the shortest wavelength of radio frequency transmission used in the system. For example, according to established allotments of radio spectrum; where transponder 42 operates in a low frequency (LF) embodiment, transponder 42 operates at about one hundred twenty five (125) kilo hertz (KHz) to about one hundred thirty five (135) KHz. In a high frequency embodiment, transponder 42 operates at about thirteen point five six (13.56) mega hertz (MHz). In an ultra high frequency (UHF) embodiment, transponder 42 operates at about eight hundred sixty eight (868) MHz to about nine hundred thirty (930) MHz. Alternatively, in a microwave embodiment, transponder 42 operates at about two point four five (2.45) giga hertz (GHz) or about five point eight (5.8) GHz. Thus, where transponder 42 is used in a low frequency embodiment, the maximum gap in an enclosing Faraday cage comprising shield 44 and bottom rail 20 (and possibly with other secondary shielding elements as required) surrounding transponder 42 to prevent a signal is about two point four (2.4) meters (m). In a microwave embodiment of about five point eight (5.8) GHz, the maximum gap in Faraday cage including shield 44 surrounding transponder 42 to prevent a signal is about point zero five (0.05) millimeters (mm). Although examples of maximum gap distances of Faraday cage including shield 44 surrounding transponder 42 are described above, gaps may also be less than the shortest wavelength of radio frequency transmission used in the system.

To achieve acceptably small gaps and to avoid inadvertent movement of rail-mounted transponder 42 away from shield 44 (thereby opening a transmissive gap in the Faraday cage), a guiding interlock (e.g., a mechanical interlock or mechanical nest) may be used. A guiding interlock may be embodied as elements engaged in a frictional or interference fit, a tongue and groove, or a two part lock separable by a predetermined force. In another embodiment, transponder 52 and corresponding shield 44 or bottom rail 20 (whichever is not attached to transponder), each further comprise a magnetic portion (e.g., a bonded-magnetic label) such that transponder 42 is magnetically attracted to bottom rail 20 or shield 44) and provides a resistive force to minor movement of window treatment 12. Thus, using a guiding interlock or magnetic portions for transponder 52, false alarms are reduced from wind-blown motion of window covering 12 (or inadvertent movement due to the motion of a pet).

As discussed above, a guiding interlock may be embodied as, for example, a mechanical or magnetic solution. The guiding interlock may be configured to locate transponder 42 relative to bottom rail 20 or shield 44, as shown for example by the fit between ears 46 and cavity 36. Moreover, the guiding interlock may provide a holding force for bottom rail 20 and shield 44, typically either by mechanical snap-in fit (as with well-known hold-down brackets for window treatments mounted on swinging doors) or by magnetic attraction. The holding force may be calibrated to hold bottom rail 20 and shield 44 together under nuisance conditions (e.g., a pet brushing against window treatment 12, or a short wind gust) while allowing bottom rail 20 and shield 44 to separate under disturbance from a child, or an intrusion. Moreover, where certain window treatments are used for a child's room, they may be calibrated with a lower holding force than, for example, a window treatment in a garage.

Figure 4:
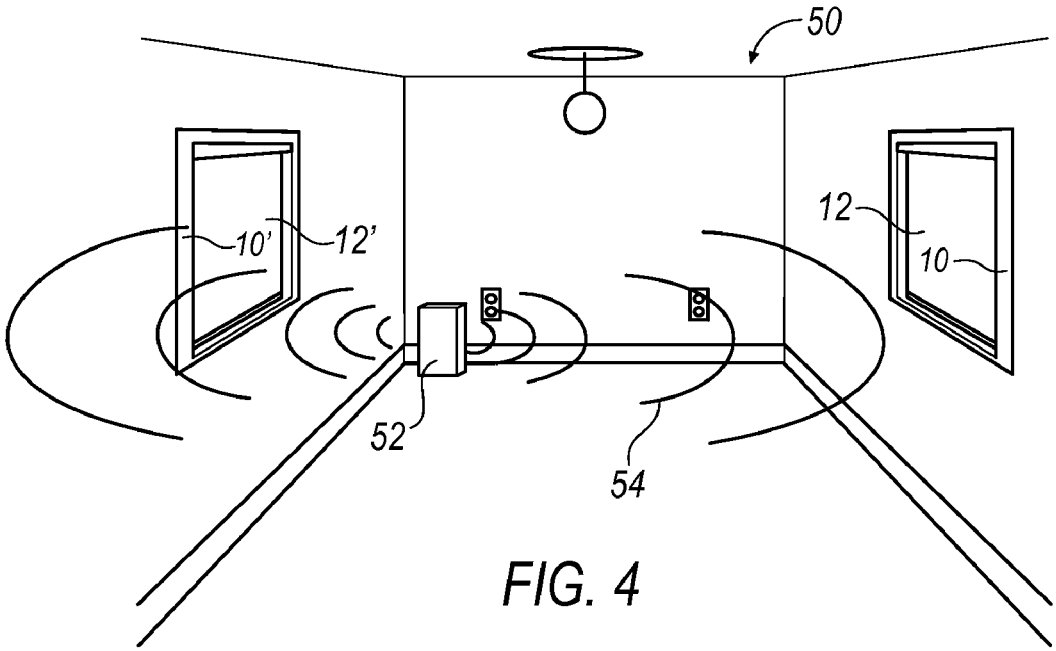
FIG. 4 is a perspective view of a detection system in an undisturbed state (i.e., a secure state) according to a first embodiment.

FIG. 4 is a perspective view of a detection system in an undisturbed state 50 (i.e., a secure state) according to a first embodiment. Undisturbed state 50 includes windows 10, 10', window treatments 12, 12', a reader 52, and reader RF signals 54. Windows 10, 10' include shields 44 (not shown, see FIG. 1) on window sills 16 (not shown, see FIG. 1). Window treatments 12, 12' include bottom rails 20 and transponders 42 (not shown, see FIG. 3). As shown, window treatments 12, 12' are fully deployed in a down position such that transponders 42 are enclosed between shields 44 and bottom rails 20. Thus, reader RF signals 54 are transmitted by reader 52 but are not responded to by transponders 42 because they are enclosed and therefore RF shielded.

Where passive transponders are used, transponders 42 will not receive power (reader RF signals 54) from reader 52 and, even where some power from reader 52 is received by transponder 42, transponder 42 cannot transmit to reader 52 because of the enclosure. Where semi-passive transponders are used, transponder 42 will not receive a query (reader RF signals 54) from reader 52. Thus, battery power is conserved. Such a system may economically facilitate use of long-life semi-passive tags because energy is not expended by transponders 42 in a secure state.

Figure 5:
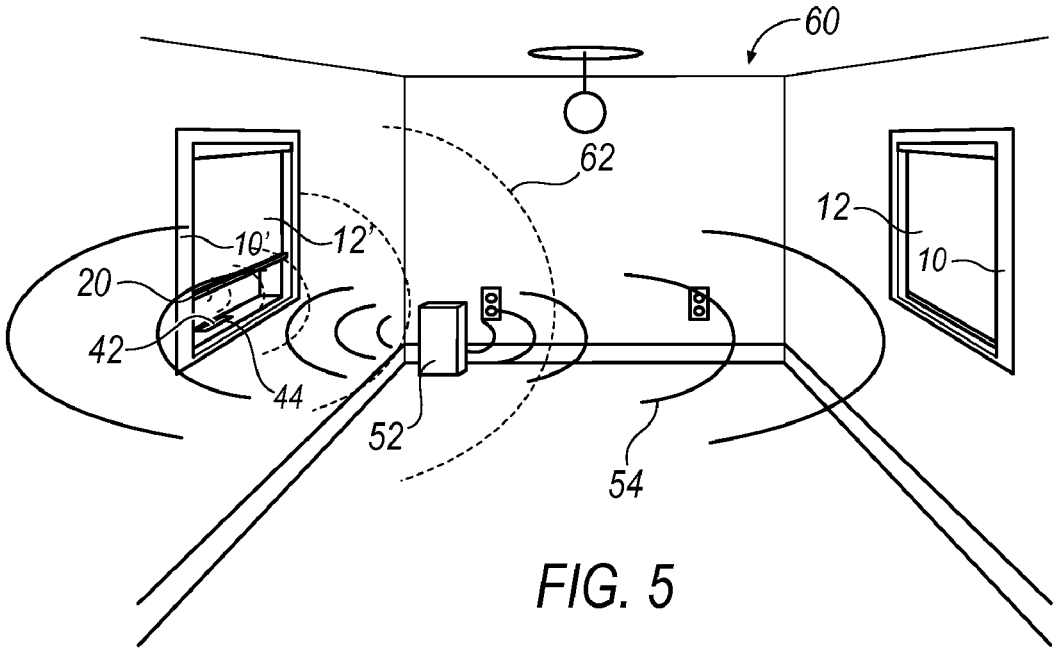
FIG. 5 is a perspective view of a detection system in a disturbed state according to the embodiment of FIG. 4.

FIG. 5 is a perspective view of a detection system in a disturbed state 60 according to the embodiment of FIG. 4. Here, window covering 12' is partially open creating a gap between bottom rail 20 and shield 44. Thus, transponder 42 (in this embodiment affixed to shield 44) is exposed and allowed to transmit. Reader RF signals 54 are received by transponder 42 and a transponder signal 62 is transmitted. The presence of transponder signal 62 indicates an insecure or disturbed state. In contrast to FIG. 4 showing an undisturbed state and without a transmission from transponder 42, FIG. 5 shows a transmission from transponder 42 that was not present in FIG. 4. Reader 52 detects the presence of transponder signal 62 and indicates an alert status because the room is now determined to be insecure. In this way, transponder 42 does not signal reader 52 until a portal or a portal feature like a window treatment is disturbed.

In further contrast to undisturbed state 50 of FIG. 4, when window 10' is disturbed, window treatment 12' is also necessarily disturbed and a separation occurs between shield 44 and bottom rail 20. The disturbance and separation of shield 44 and bottom rail 20 allow transponder 42 to receive power from reader 52 (in the case of a passive transponder) or to receive a query from reader 52 and transmit a response (in the case of a semi-passive transponder).

In other embodiments, transponders 42 are integrated with windows 10 and window treatments 12. A repeater-reader (explained in detail below with respect to FIG. 7) may be used that allows for localized security to a room and also a networked security system with other readers 52 and/or repeater-readers that communicate with each other to determine a secure/insecure status. In this way, each window and door, including a transponder 42, may act as a wireless security device. Moreover, by using multiple readers and repeater-readers, the indication of an insecure status may be structure or household wide. That is to say, the indication of an insecure status from one window may be determined by a reader or repeater-reader and retransmitted to the other readers or repeater-readers or a centralized security system to indicate the insecure status.

Figure 6:
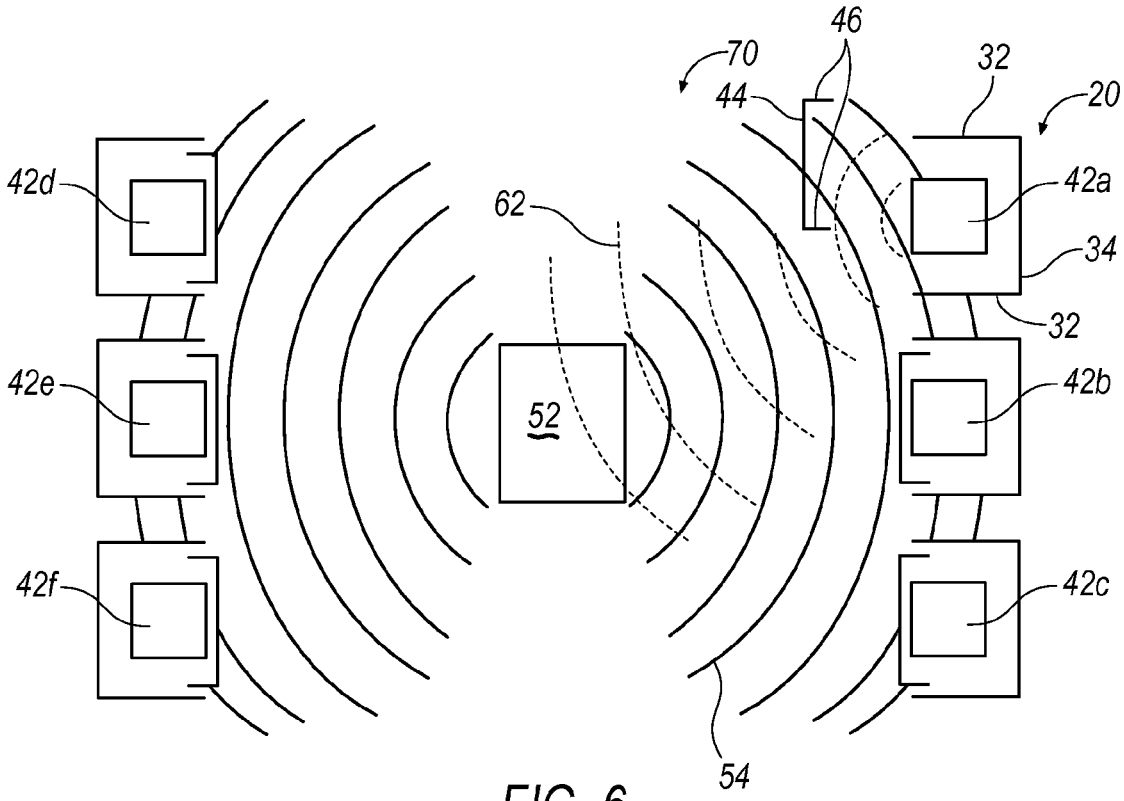
FIG. 6 is a single region diagram of the system of FIG. 4 including multiple transponders.

FIG. 6 is a single region diagram 70 of the system of FIG. 4 including multiple transponders 42*a*-42*f*. As shown, window 10*a* is in a disturbed state where shield 44 is not proximate to bottom rail 20 such that transponder 42*a* is not surrounded and prevented from sending a signal. The other transponders 42*b*-42*f* are not disturbed and are not able to receive or transmit signals. However, because transponder 42*a* is disturbed, transponder 42*a* receives reader RF signals 54 and transmits a transponder signal 62 in response indicating an insecure condition.

Figure 7:
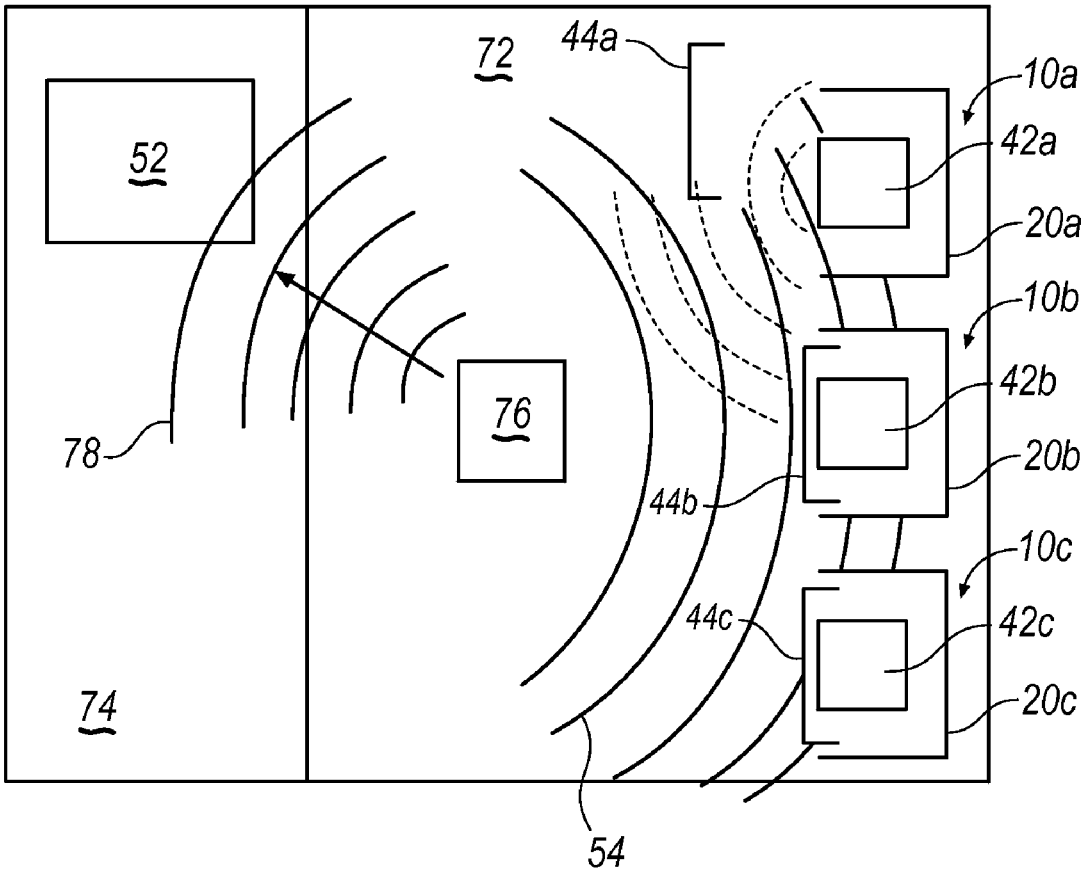
FIG. 7 is a multiple region diagram including a reader-repeater according to a second embodiment.

FIG. 7 is a multiple region diagram 80 including a reader-repeater 76 according to a second embodiment. Reader-repeater 76 includes the capability to send signals to transponders, receive signals from transponders, and send signals to other reader-repeaters 76 or readers 52. The connectivity of reader-repeater 76 allows for localized reading of transponders 42, but also provides for centralized communication or indication of a secure or insecure condition. A first region 72 (e.g., a garage) may include three (3) windows 10*a*-10*c* and the associated window coverings and transponders 42*a*-42*c*. As shown, window 10*a* is in a disturbed state such that transponder 42*a* receives reader RF signals 54 (in this embodiment from a reader-repeater 76).

Reader-repeater 76 sends a repeater signal 78 to reader 52 that is in a second region. While reader-repeater 76 may be located in first region 72, the secure or insecure status information may be transmitted to second region 74 or others by repeater signal 78. The system, including multiple regions and also localized reading of the transponders, allows for the use of less costly passive transponders for the portals (e.g., window, door, etc.). Reader-repeater 76 locally determines the presence or absence of a transponder signal 62 and will send a signal or update the status by way of repeater signal 78.

As will be understood by those skilled in the art, the embodiments including window covering and metallic shields are not the only means to accomplish the aforementioned security embodiments. Other embodiments include the use of multiple readers 52, multiple transponders 42, a mixture of passive transponders and semi-passive transponders, a mixture of readers 52 and reader-repeaters 76 and the use of amplifiers. Moreover, the theory of operation may also be reversed such that the presence of a transponder signal indicates an undisturbed (i.e., secure) state and the absence of a transponder signal indicates a disturbed (i.e., insecure) state. Another embodiment may include the use of local amplifiers or antenna arrangements such that the position of the transponder is determined. When a change of position of the transponder is sensed, for example, the window covering is presumed to have been disturbed and an insecure indication is recorded.

In another embodiment, each of transponders 42*a*-42*c* comprises a unique identifier that is transmitted to reader 52 and reader-repeater 76. Using the unique identifier, reader 52, reader-repeater 76, or any other device (e.g., a centralized security system), the individual transponder 42*a*-42*c* disturbed is established. Thus, the unique identifier further allows for a determination of which aperture (e.g., window or door) has been disturbed. For example, where a signal is received and uniquely identified as transponder 42*a*, reader-repeater 76 associates the unique identifier with window 10*a*. Thus, the system now knows which of windows 10*a*-10*c*, individually or in combination, has been disturbed.

Figure 8:
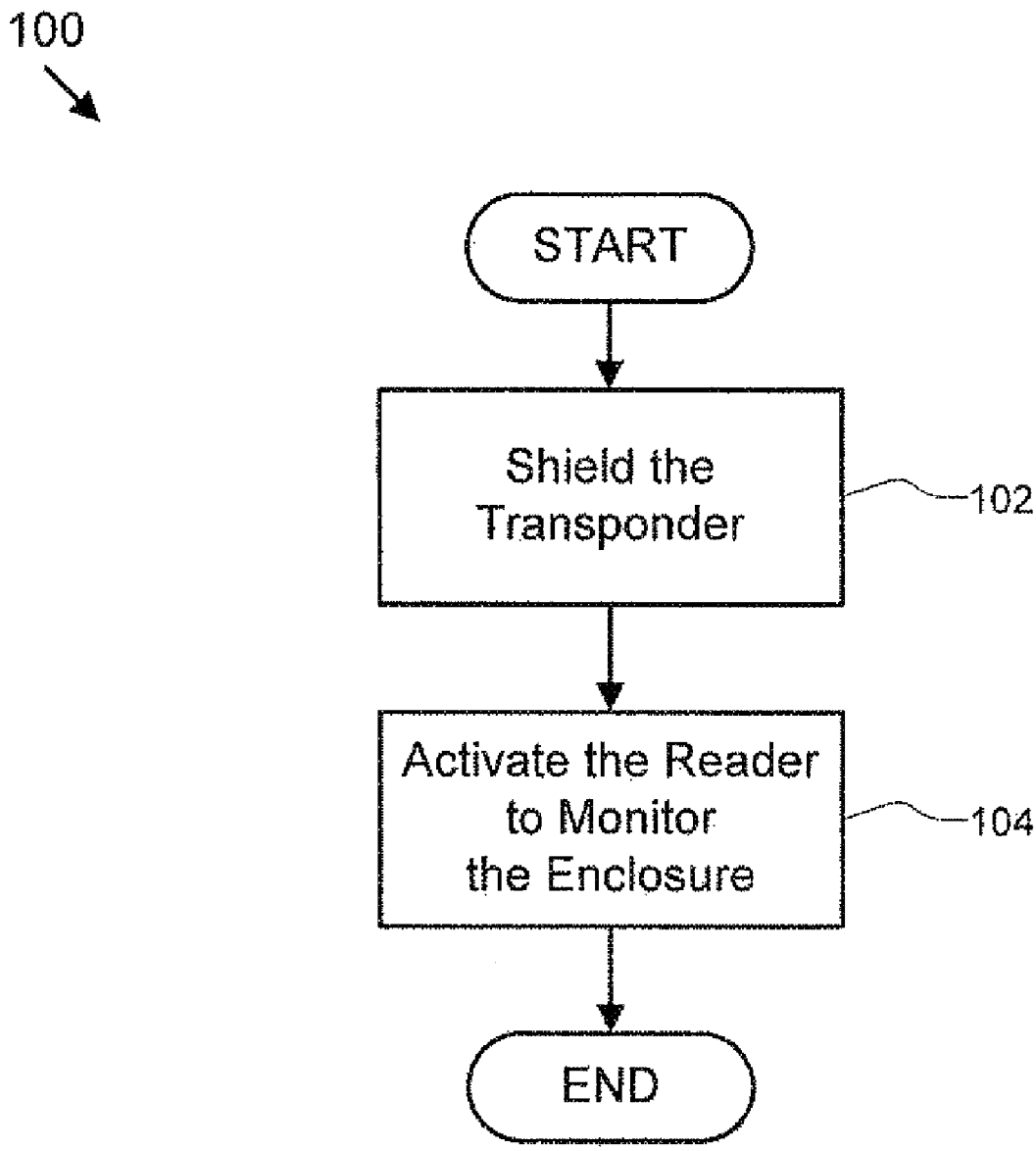
FIG. 8 is a process flow for securing an enclosure.

FIG. 8 is a process flow 100 for securing an enclosure. The process begins at step 102 where a user secures the room by shielding transponder 42. In the embodiment of FIG. 4, transponder 42 is shielded by lowering window treatments 12, 12' such that transponder 42 is shielded by shield 44 and lower rail 20 for each window 10, 10'. The user may perform this action for any number of windows, doors, or other portals. The process then proceeds to step 104.

At step 104, the user activates reader 52 such that monitoring of the enclosure is performed by reader 52 to detect an intrusion or a disturbance. Reader 52 may be monitoring a single enclosure, or reader 52 may be connected to other readers 52 and/or reader-repeaters 76 to secure a plurality of enclosures or a structure comprising a plurality of enclosures (e.g., rooms). The process flow then ends.

Figure 9:
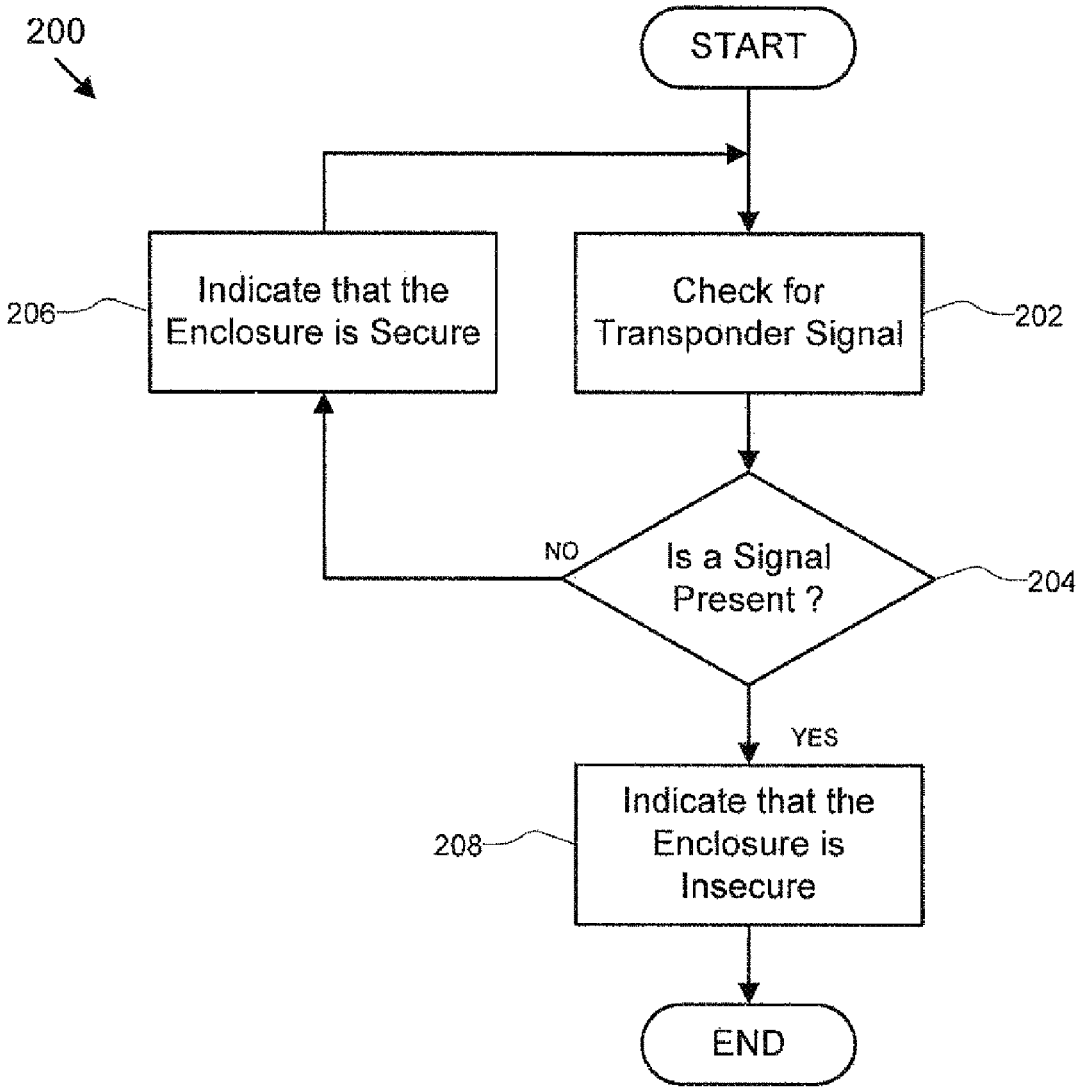
FIG. 9 is a process flow for the reader determining the state of an enclosure.

FIG. 9 is a process flow 200 for reader 52 determining the security state of an enclosure. In an embodiment, transponder 42 does not communicate with reader 52 in secure state. Before the process begins, and in normal operation, a user would have secured the enclosure (as is shown in FIG. 8). The process begins at step 202 where reader 52 checks for the presence of transponder signal 62 (see FIG. 5 above). The circuits of reader 52 typically send out an RF pulse that, when passive transponder 42 is unshielded, is reflected (or retransmitted) including a modulation that is discernable by reader 52. In this way, reader 52 can determine that transponder signal 62 is present. In another embodiment, where a semi-passive transponder 42 is used, the RF pulse may trigger semi-passive transponder 42 to transmit another signal which is discernable by reader 52. The process flow then proceeds to step 204.

In step 204, reader 52 determines if a signal is present. If a signal is not present, reader 52 deems the enclosure secure. For example, in the embodiment of FIG. 4, transponder 42 is shielded. Thus, transponder signal 62 is not present (e.g., the enclosure is secured). Indeed, no signal from transponder 42 is received by reader 52. However, in the embodiment of FIG. 5, where a signal is present (e.g., transponder signal 62), reader 52 determines that the enclosure is insecure. If no signal is present, the room is deemed secure and the process flow proceeds to step 206 and repeats the flow sequence from step 202, typically after a predetermined interval of time. If transponder signal 62 is present, the room is deemed insecure and the process flow proceeds to step 208.

In step 206, reader 52 indicates that the enclosure is secure. Such an indication may be a light indicating a secure condition, an electrical output signal, or the absence of an alarm.

The process flow then proceeds to step 202 where reader 52 continues monitoring for transponder signal 62.

In step 208, the reader indicates that the enclosure is insecure. Because transponder signal 62 is received, reader 52 interprets the presence of transponder signal 62 as a breach of a portal of the enclosure. Thus, an indication of the intrusion or disturbance should be communicated to a user and/or another system. The insecure indication may be a light indicating an insecure condition, an electrical output signal, or sounding an alarm. Moreover, reader 52 may further indicate to other readers 52 and/or reader-repeaters 76, or a central control that the intrusion or disturbance has occurred. The process flow then ends.

Figure 10:
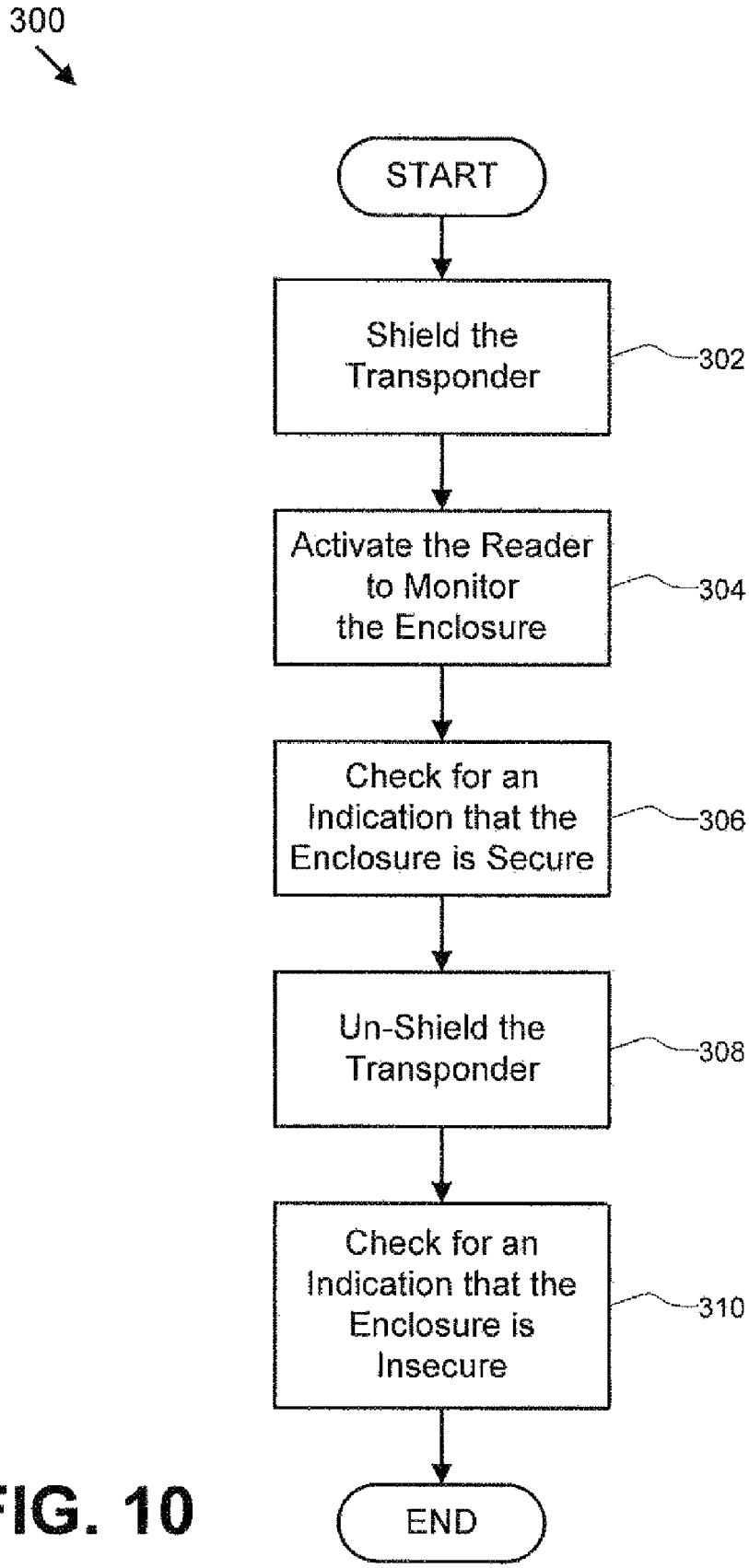
FIG. 10 is a process flow for testing the detection system.

FIG. 10 is a process flow 300 for testing the security system. In an embodiment, transponder 42 does not communicate with reader 52 in secure state. The test 300 begins at step 302 where a user shields transponder 42 (or multiple transponders 42) and secures the enclosure. The process flow then proceeds to step 304.

At step 304, the user activates reader 52 to begin monitoring the status of the enclosure. The process flow then proceeds to step 306.

At step 306, reader 52 monitors for an intrusion or a disturbance of the enclosure. As described in process flow 200 above, reader 52 monitors for the absence or presence of an unshielded transponder 42, indicated by the absence or presence of transponder signal 62. The process flow then proceeds to step 308.

At step 308, the user un-shields transponder 42. The unshielding can be accomplished by moving window covering 10' such that lower rail 20 is moved away from shield 44 and exposing transponder 42 (as shown in FIG. 5). This example of un-shielding transponder 42 simulates an intrusion or a disturbance of the enclosure. The process flow then proceeds to step 310.

At step 310, the user checks for an indication from reader 52 that the enclosure is insecure. As mentioned above, the indication could be a light, digital display, and/or alarm, etc. If there is an indication that the enclosure is insecure, the user knows that the system is properly configured for the particular transponder 42 that was exposed. The user may wish to test each transponder 42 to verify that the system is working properly for each and every transponder 42. If there is no indication that the room is insecure, the user knows that the system may be improperly configured. The process flow then ends.

Figure 11:
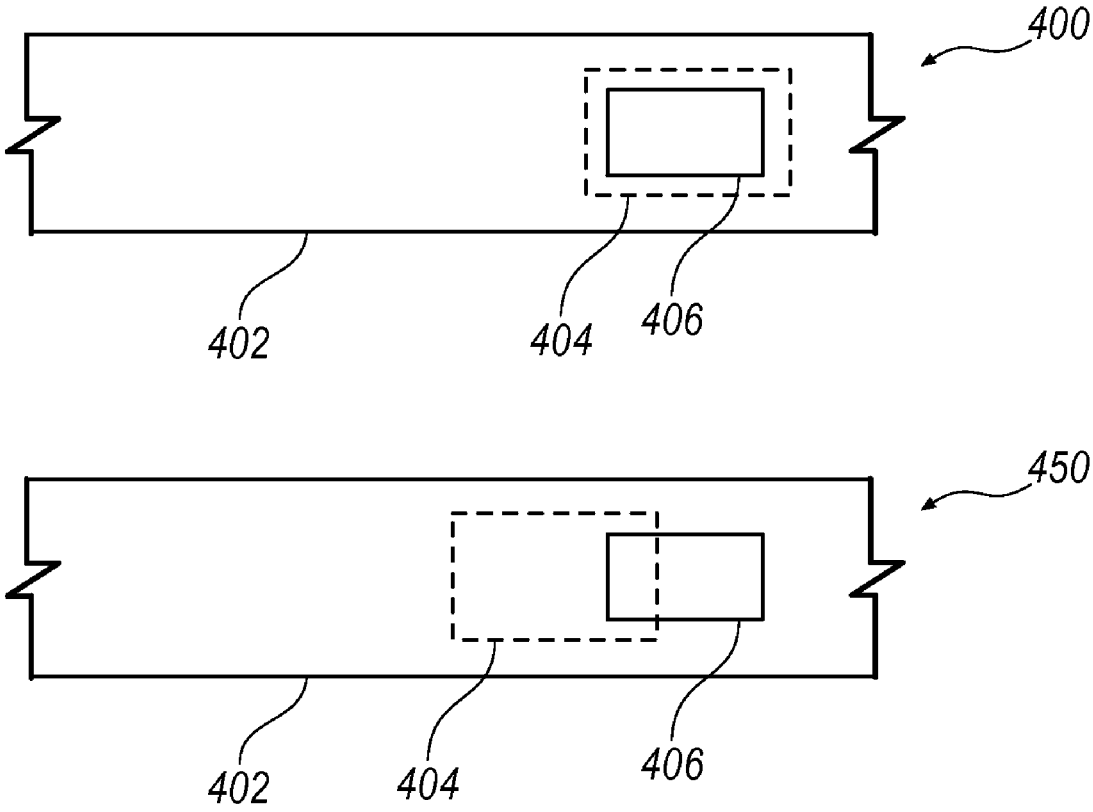
FIG. 11 shows plan views of a first embodiment and a second embodiment of a separable antenna system.

FIG. 11 shows plan views of a first embodiment 400 and a second embodiment 450 of a separable antenna system including a RFID tag 406 and an antenna 404. A window sill 402 holds antenna 404 and a window covering (shown in FIG. 12) holds RFID tag 406. First embodiment 400 shows antenna 404 as being located generally centered over RFID tag 406. Second embodiment 450 shows antenna 404 as being located generally askew, but still overlapping RFID tag 406. When antenna 404 is proximal to RFID tag 406, antenna 404 behaves to enhance the range of RFID tag 406. Thus, when antenna 404 is located near RFID tag 406, an interrogation signal, such as a signal by reader 52 (shown in FIG. 6), RFID tag 406 is able to respond. Where antenna 404 is proximal to RFID tag 406, the radio frequency coupling allows antenna 404 to behave as a signal enabler (e.g., an antenna, or range extender) for RFID tag 406 in that antenna 404 provides for the signal being transmitted at a greater range than where RFID tag 406 is transmitting alone. Indeed, without antenna 404, RFID tag 406 is not capable of transmitting beyond a short distance that would require a reader to be proximal to RFID tag 406 to detect a signal, if at all.

Figure 12:
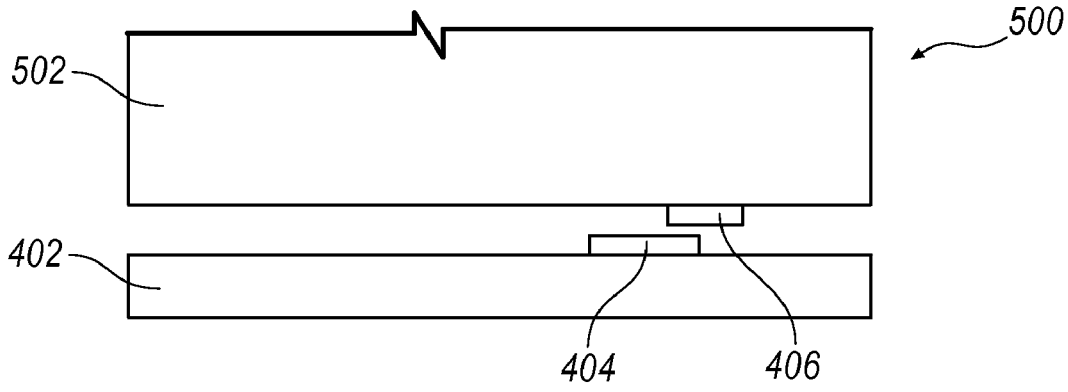
FIG. 12 is a front elevational view of the second embodiment of FIG. 11 including a window covering in an undisturbed state.

FIG. 12 is a front elevational view of the second embodiment 450 of FIG. 11 in an undisturbed state 500 and used with a window covering 502. Window covering 502 includes RFID tag 406 and is not alone able to be interrogated by reader 52 (shown in FIG. 6). When antenna 404 (attached to window sill 402) is proximal to RFID tag 406 (as shown here in FIG. 12), RFID tag 406 is able to send a signal in response to an interrogation signal from reader 52 due to the radio frequency coupling of antenna 404 and RFID tag 406. The signal is generated at RFID tag 406 and is coupled to antenna 404 for transmission to the environment. Thus, when window covering 502 is in an undisturbed state, RFID tag 406 is able to send a signal to reader 52 (shown in FIG. 6).

Figure 13:
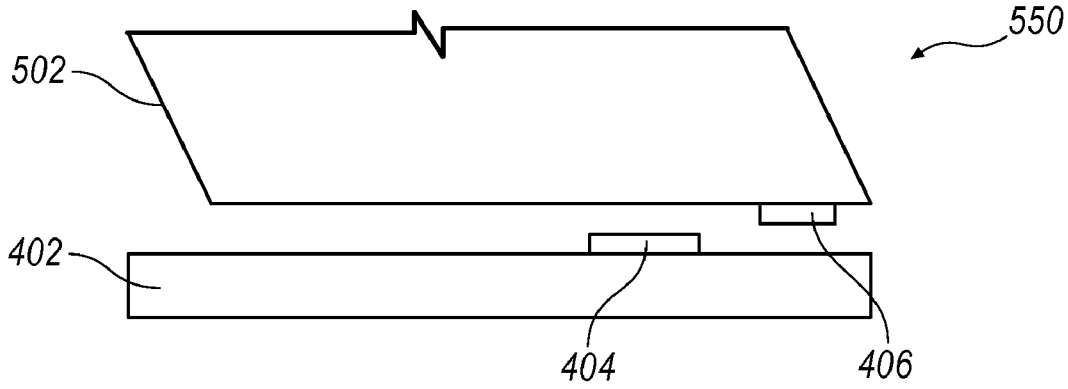
FIG. 13 is a front elevational view of the embodiment shown in FIG. 12 wherein the window covering is in a disturbed state.

FIG. 13 is a front elevational view of the embodiment shown in FIG. 12 and wherein window covering 502 is in a disturbed state 550. As shown, window covering 502 is moved sideways such that RFID tag 406 is separated from antenna 404. Because RFID tag 406 requires antenna 404 to be in proximity to communicate with reader 52 (shown in FIG. 6), the lack of a signal from RFID tag 406 signals a disturbed state or an intrusion. Thus, the embodiments described herein with respect to FIGS. 11-13 signal intrusion by the lack of a signal from RFID tag 406 to reader 52 (shown in FIG. 6).

As is also discussed above with respect to FIG. 3, to avoid inadvertent movement of RFID tag 406 from antenna 404, a guiding interlock (e.g., a mechanical interlock or mechanical nest) may be used. In an embodiment, RFID tag 406 and antenna 404 each further comprise a magnetic portion (e.g., a bonded-magnetic label) such that RFID tag 406 and antenna 404 are magnetically attracted to each other. When using a magnetic system, the constant magnetic fields from the magnetic portions do not interfere with the fluctuating fields of the radio frequency signals associated with reader 52 (shown in FIG. 6) or the response from RFID tag 406 and antenna 404. Thus, using a guiding interlock or attractive magnetic portions for RFID tag 406 and antenna 404, false alarms are reduced from wind-blown motion (or movement due to pet motion) of window covering 502.

In contrast to the embodiments described above with respect to FIGS. 1-10, the embodiments described herein with respect to FIGS. 11-13 operate to detect an intrusion by the absence of a signal, rather than the presence of a signal as described above with respect to FIGS. 1-10. In sum, the transponder and shield embodiments (described in detail above with respect to FIGS. 1-10) behave to allow the transponder to send a signal when disturbed, and alternatively, the RFID tag and antenna embodiment described with respect to FIGS. 11-13 behave to prevent the RFID tag from sending a signal when disturbed.

For all of the embodiments disclosed herein, the radio frequency portion (e.g., transponder 42 or RFID tag 406) for each embodiment may be shipped permanently affixed to a product portion (e.g., a rail or a shield) or may be added by an installer or user during final installation. Where the radio frequency component (e.g., transponder 42 or RFID tag 406) is desired to be used as an RFID tag for inventory control, as well as an element of a security system, the RFID tag may be mounted or packaged to allow for an RFID inventory scanner to read the information from the RFID tag. However, when the RFID tag is to be mounted to a shield (such as is described as an alternative in FIG. 3), it is desirable to have the RFID tag affixed to the shield during final installation rather than before shipping. Otherwise, the shield may interfere with the RFID inventory scanner's interrogation of the RFID tag and prevent the RFID tag being used for inventory control. In these cases, an in any case where the RFID tag is otherwise shielded or prevented from receiving and/or transmitting, a peelable multi-layer RFID tag is preferred such that the user or installer may peel the unshielded tag away from the packaging and affix it to a shield, bottom rail, window sill, etc., during installation (see FIGS. 1-10). When an RFID tag and antenna are used, one or both of RFID and antenna may use peelable multi-layer substrates for final assembly by a user or installer. In any case, such a peelable RFID tag allows for the user or installer to affix the RFID tag at any position (e.g., allows for adjustable positioning) of the tag to provide for the best signal to a reader or to achieve a less obtrusive, more aesthetically pleasing location.

The present invention has been particularly shown and described with reference to the foregoing embodiments, which are merely illustrative of the best modes for carrying out the invention. It should be understood by those skilled in the art that various alternatives to the embodiments of the invention described herein may be employed in practicing the invention without departing from the spirit and scope of the invention as defined in the following claims. The embodiments should be understood to include all novel and non-obvious combinations of elements described herein, and claims may be presented in this or a later application to any novel and non-obvious combination of these elements. Moreover, the foregoing embodiments are illustrative, and no single feature or element is essential to all possible combinations that may be claimed in this or a later application.

With regard to the processes, methods, heuristics, etc. described herein, it should be understood that although the steps of such processes, etc. have been described as occurring according to a certain ordered sequence, such processes could be practiced with the described steps performed in an order other than the order described herein. It further should be understood that certain steps could be performed simultaneously, that other steps could be added, or that certain steps described herein could be omitted. In other words, the descriptions of processes described herein are provided for illustrating certain embodiments and should in no way be construed to limit the claimed invention.

Accordingly, it is to be understood that the above description is intended to be illustrative and not restrictive. Many embodiments and applications other than the examples provided would be apparent to those of skill in the art upon reading the above description. The scope of the invention should be determined, not with reference to the above description, but should instead be determined with reference to the appended claims, along with the full scope of equivalents to which such claims are entitled. It is anticipated and intended that future developments will occur in the arts discussed herein, and that the disclosed systems and methods will be incorporated into such future embodiments. In sum, it should be understood that the invention is capable of modification and variation and is limited only by the following claims.

All terms used in the claims are intended to be given their broadest reasonable constructions and their ordinary meanings as understood by those skilled in the art unless an explicit indication to the contrary is made herein. In particular, use of the singular articles such as "a," "the," "said," etc. should be read to recite one or more of the indicated elements unless a claim recites an explicit limitation to the contrary.

We claim:

1. A system, comprising:

a transponder configured to send a signal;

a shield configured to prevent said transponder from sending said signal, wherein said transponder and said shield are movable relative to each other to permit a transmission of said signal from said transponder, and wherein movement of said transponder and said shield relative to each other is indicated by the presence of said signal and, a portal feature, wherein at least one of said transponder and said shield is movable with said portal feature, and wherein the presence of said signal indicates a disturbance of said portal feature.

2. The system of claim 1, further comprising:

a receiver for said signal, said receiver interpreting an absence of said signal as a normal condition and the presence of said signal as an indication of said disturbance.

3. The system of claim 1, said shield further comprising:

a first element and a second element, said first and second elements substantially surrounding said transponder in a first position, and being selectively movable from each other to expose said transponder and allow said signal to be sent.

4. The system of claim 1, said shield further comprising:

a bottom rail as part of a window treatment, whereby the position of said window treatment determines whether said transponder is shielded or exposed.

5. The system of claim 1, wherein said transponder includes a radio frequency (RF) component.

6. The system of claim 1, further comprising:

a transceiver configured to provide power to said transponder via a radio-frequency transmission, said transceiver further configured to receive a response from said transponder when said transponder and said shield are moved relative to each other.

7. The system of claim 1, further comprising:

a transceiver configured to send a signal to elicit a response from said transponder.

8. The system of claim 1, further comprising:

a window treatment, wherein at least one of said transponder and said shield is attached to said window treatment.

9. A system, comprising:

a transponder;

a shield configured to substantially prevent said transponder from sending a signal;

a portal feature, wherein at least one of said transponder and said shield is movable with said portal feature; and a reader, wherein a physical movement of at least one of said transponder and said shield allows said transponder to send said signal to said reader, wherein the sending of said signal indicates a disturbance of said portal feature.

10. The system of claim 9, wherein the presence of said signal indicates an insecure state and the absence of said signal indicates a secure state.

11. The system of claim 9, wherein said transponder includes a radio frequency (RF) component.

12. The system of claim 9, further comprising:

a window treatment, wherein at least one of said transponder and said shield is attached to said window treatment.

13. A system comprising:

a portal feature;

a transponder configured to provide a signal; and a shield configured to selectively substantially complete a Faraday cage about said transponder and substantially inhibit a transmission of said signal when said transponder is caged, wherein at least one of said transponder and said shield is movable with said portal feature, and wherein the presence of said signal further indicates a disturbance of said portal feature.

14. The system of claim 13, further comprising a transceiver configured to detect the presence and absence of said signal, wherein the absence of said signal indicates a secure state, and wherein the presence of said signal indicates an insecure state.

15. The system of claim 13, wherein said shield is selected from the group comprising a metal, a conductive plastic, a conductive ceramic, a conductive composite, a wood, and a foil.

16. The system of claim 13, wherein said transponder includes a radio frequency (RF) component.

17. The system of claim 13, wherein at least one of said transponder and said shield is attached to a window treatment.

* * * * *